United States Patent [19]

Steeman et al.

[11] 4,349,764

[45] Sep. 14, 1982

[54] LOW-PRESSURE METAL VAPOR DISCHARGE LAMP

[75] Inventors: Peter K. R. M. Steeman; Karel R. Vervecken, both of Eindhoven, Netherlands

[73] Assignee: U.S. Philips Corporation, New York, N.Y.

[21] Appl. No.: 189,969

[22] Filed: Sep. 22, 1980

[30] Foreign Application Priority Data

Sep. 28, 1979 [NL] Netherlands ..... 7907220

[51] Int. Cl.[3] ..... H01J 19/70; H01J 61/24

[52] U.S. Cl. ..... 313/176; 313/180

[58] Field of Search ..... 313/180, 176, 174 (U.S. only)

[56] References Cited

U.S. PATENT DOCUMENTS 2,089,325 8/1937 Aldington ..... 313/176 X 3,274,415 9/1966 Thomas et al. ..... 313/176 X 3,737,710 6/1973 Waymouth et al. ..... 313/174

FOREIGN PATENT DOCUMENTS 913468 12/1962 United Kingdom .

*Primary Examiner*—Robert Segal

*Attorney, Agent, or Firm*—Robert S. Smith

[57] ABSTRACT

The invention relates to a low-pressure metal vapor discharge lamp comprising a discharge tube and an outer bulb enveloping the discharge tube. Provided between the discharge tube and the outer bulb are a barium-containing getter and an electrical resistor which, in operation assumes a temperature of at least 500° C., for cracking $CH_4$ gas.

According to the invention, the resistor is enveloped for the greater part by a ceramic tube, which prevents the electrons emitted by the hot resistor from being deposited on the exterior of the discharge tube wall.

2 Claims, 4 Drawing Figures

LOW-PRESSURE METAL VAPOR DISCHARGE LAMP

The invention relates to a low-pressure metal vapor-discharge lamp having a discharge tube arranged in an evacuated outer bulb, current conductors being lead in a vacuum-tight manner through the wall of the outer bulb and the wall of the discharge tube into the discharge tube where they are each connected to a respective electrode, a barium-containing getter and an electric getter auxiliary means in the form of an electric resistor being present in the evacuated space between the discharge tube and the outer bulb, the resistor receiving in the operating condition of the lamp an electric current by way of the current conductors, the resistor then assuming a temperature in the range from 500°-2000° C.

A known low-pressure metal vapor discharge lamp of the above-described type is disclosed in, for example, the publication "Niederdruckentladungslampe" in the periodical "Neues aus der Technik" dated Apr. 1, 1977, page 4.

The inventors found that it is indeed possible to obtain a permanently good vacuum (pressure below approximately $10^{-2}$ Pascal) between the discharge tube and the outer bulb of that known low-pressure metal vapour discharge lamp, so that the heat losses of the lamp are reduced, but that the operating life of that known lamp is only short. This short life is a drawback.

The following should be noted with respect to the vacuum. The barium-containing getter present between the discharge tube and the outer bulb absorbs, for example, the carbon monoxide, but methane ($CH_4$) is thereafter produced by way of barium carbide. This methane in the outer bulb, which would cause the heat losses of the lamp to increase, is cracked by the hot electric resistor (500° to 2000° C.). The hydrogen gas then produced is thereafter absorbed by the barium-containing getter, which results in the vacuum of good quality.

The inventors have realised that the short operating life of the known lamp must be attributed to the electrons which are emitted by the hot resistor and settle on the outer wall of the discharge tube, where these electrons result in outwardly directed forces on the metal ions in the discharge tube. This causes the metal intended for the discharge to disappear from the discharge space of the discharge tube, and also causes electrolysis of the discharge tube wall, which initiates a rapid end of the life of the lamp.

It is an object of the invention to provide a low-pressure metal vapor discharge lamp of the type described in the opening paragraph, which has a relatively long operating life.

A low-pressure metal vapor discharge lamp according to the invention, having a discharge tube arranged in an evacuated outer bulb, current conductors being lead in a vacuum-tight manner through the wall of the outer bulb and the wall of the discharge tube into the discharge tube where they are each connected to a respective electrode, a barium-containing getter and an electric getter auxiliary means in the form of an electric resistor being present in the evacuated space between the discharge tube and the outer bulb, the resistor receiving an electric current in the operating condition of the lamp by way of the current conductors, the resistor then assuming a temperature in the range from 500°-2000° C., is characterized in that the resistor is enveloped for the greater part by a hollow insulating element.

This lamp has the advantage that its operating life is relatively long, whilst a permanently good vacuum is maintained in the space between the discharge tube and the outer bulb.

The invention is based on the motion to prevent the electrons which—in the operating condition of the lamp—are emitted by the hot resistor, which has a temperature of 500° to 2000° C. from landing on the discharge tube. The arrangement in accordance with the invention, the resistor being located in the cavity of the insulating element, causes the electrons which are emitted by the resistor immediately after the lamp has been switched on to land predominantly on the inside of the wall of the insulating element. Consequently, these electrons form a negative electric charge on the inside of that wall of the insulating element. This negative wall charge opposes the escape of further electrons from the hot resistor. In this manner it is prevented in a simple and efficient manner that the electrons land on the outside wall of the discharge tube wall.

It should be noted that the insulating element does not fully enclose the hot resistor, but does so for the major part. Namely, if the insulating element were to hermetically seal the resistor, the above-mentioned cracking process of the methane—which is necessary to obtain a proper vacuum between the discharge tube and the outer bulb—would not be possible.

It should further be noted that from United Kingdom Patent Specification No. 913,468 a low-pressure metal vapor discharge lamp is known which includes both a barium-containing getter and an electric getter auxiliary means in the space between a discharge tube and an outer bulb. However, in this United Kingdom Patent a purpose is to promote the emission of electrons in the electric getter auxiliary means, namely to ionize residual gases, as a result of which they are more readily absorbed by the lamp wall or by the getter surface. This known lamp has, however, the drawback that deionized gas molecules may become detached from the walls again. As a consequence thereof heat conductivity through the space between the discharge tube and the outer bulb increases again and the efficiency of the lamp decreases. In addition, the construction of the electric getter auxiliary means in the United Kingdom Patent is complicated.

A low-pressure metal vapor discharge lamp according to the invention may, for example, be a low-pressure sodium lamp or, for example, a low-pressure mercury lamp.

The insulating element may, for example, be made of quartz.

In a preferred embodiment of a low-pressure metal vapour discharge lamp according to the invention the insulating element is a ceramic tube.

This preferred embodiment has the advantage that the insulating element then has an improved temperature resistance.

An embodiment according to the invention will now be further explained with reference to an accompanying drawing, in which.

Figure 1:
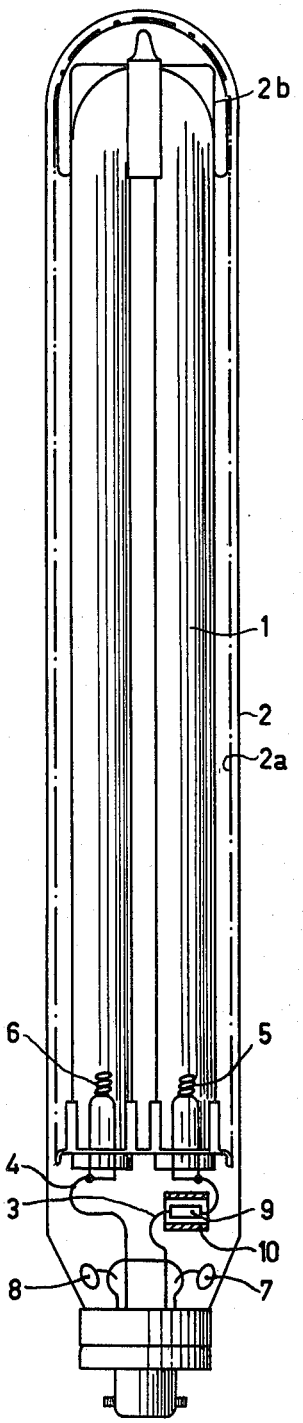
FIG. 1 shows a longitudinal section, partly elevational view, of a low-pressure metal vapor discharge lamp according to the invention.

FIG. 1 shows a low-pressure sodium vapor discharge lamp having a discharge tube 1 arranged in an outer bulb 2. The outer bulb is coated on its inside with an electrically conducting infrared reflector layer 2*a*, which predominantly consists of indium oxide. Reference numeral 2*b* denotes a metal supporting spring between the discharge tube 1 and the outer bulb 2. Conductors 3 and 4 supply current to electrodes 5 and 6. A barium getter is arranged in the lamp by means of the rings 7 and 8. An electric resistance element 9 is connected in series with the discharge tube, to the current conductor 3 and the electrode 5. A ceramic tube 10, which is open at both ends, encloses the resistor 9. This is the hollow insulating element which predominantly surrounds the resistor 9. The tube 10 is connected to the lead of the resistor 9 by means of supporting brackets (not shown).

This sodium lamp, which, in operation, consumes a power of 90 Watt, was assembled by inserting a U-shaped discharge vessel with an electrode spacing of 80 cm (=length of the discharge path) in an outer bulb. A tungsten coil—namely the resistor 9—, having a power of 0.5 W in the operating condition was provided in series with the discharge path. The outer bulb was sealed but for the exhaust tube. The latter was connected to a vacuum pump, whereafter the outer bulb was evacuated at 350° C. to a pressure of approximately 1.3 Pascal. After this pressure had been reached, the lamp remained connected to the pump for another 5 minutes, whereafter the exhaust tube was sealed and the barium getter volatilized from rings 7 and 8.

By means of a stabilization ballast (not shown) the lamp was operated at the design voltage (115 Volts), the tungsten coil in the outer bulb assuming a temperature of approximately 800° C. At this temperature a residual gas, such as methane, was cracked by the hot resistor 9. After having been in operation for 100 hours the pressure in the outer bulb was approximately $(1.3).10^{-3}$ Pascal.

Electrons emitted from the hot resistor 9 settled thereafter on the inside of the wall of the ceramic tube 10. The negative wall charge thus produced in the interior of the tube 10 opposes a further escape of electrons from the hot resistor 9. Escape of sodium from the discharge space of the discharge tube 1 is not possible in this lamp. The above-described lamp had an operating life of more than 6000 hours.

In the case where the tube 10 was omitted, a lamp which was identical in all other respects had an operating life of less than one hundred hours. This must be ascribed to the fact that the electrons emitted by the resistor 9 find their way again to the outside of the discharge tube 1 by way of the layer 2*a* and the spring 2*b*. This results in the escape of sodium from the discharge space of the tube 1, as well as in electrolysis of the glass wall of the discharge tube.

Figure 2:
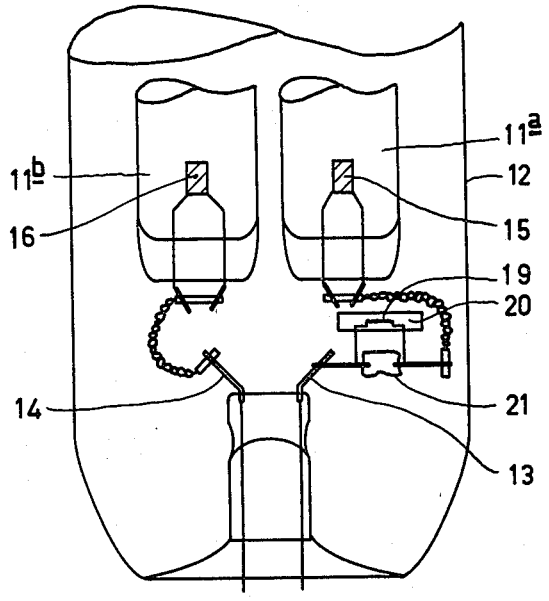
FIG. 2 shows a portion of a second low-pressure metal vapor discharge lamp according to the invention, on a different scale.

FIG. 2 shows—on a larger scale than FIG. 1—a portion of a second low-pressure sodium vapor discharge lamp. The significant features here are the way in which an electric resistor 19 is fastened, and an insulating element 20 which for the greater part envelopes that resistor. The other lamp properties are the same as those of the lamp shown in FIG. 1. Reference numerals 11*a* 11*b* designate portions of the two legs of a discharge tube, also u-shaped, these legs being located in an outer bulb. Reference numerals 13 and 14 designate current conductors. The leg 11*a* comprises an electrode 15 the leg 11*b* an electrode 16. A current conductor 13 is connected to the electrode 15 by way of an electric resistor 19, which is enveloped for the greater part by the insulating element 20 which is in the form of a ceramic tube. A current conductor 14 is connected to the electrode 16. Reference numeral 21 designates a bead which provides the mechanical connection of the resistor 19 and the ceramic tube 20. The two ends of the resistor 19 are connected to respective rigid wires fastened to that bead. For details about the construction of the assembly 19, 20 reference is made to FIG. 4.

Figure 3:
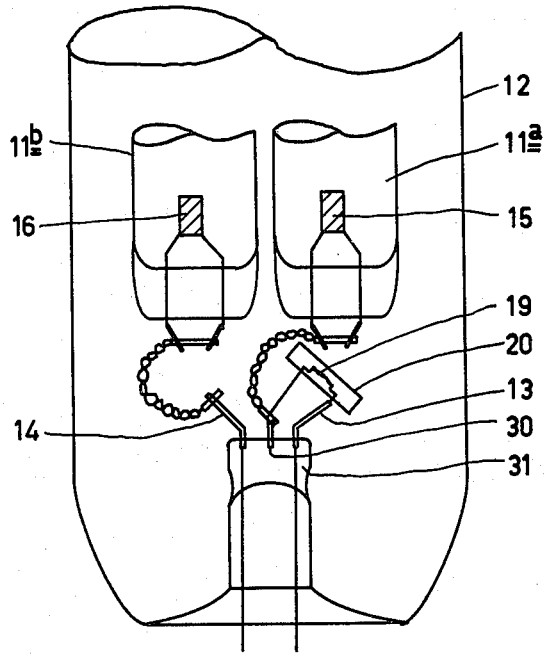
FIG. 3 shows a portion, which corresponds with FIG. 2, of a third low-pressure metal vapor discharge lamp according to the invention.

FIG. 3 shows a construction which is almost identical to that of FIG. 2. Corresponding lamp components have been given the same reference numerals as in FIG. 2, the difference being however, the manner in which the assembly of the resistor 19 and the ceramic tube 20 is fastened. For that purpose, a third connecting piece 30 is provided on a pinch 31 in the situation shown in FIG. 3. A first and a second connecting piece are formed by the current conductors 13 and 14, respectively, which project from the pinch 31. One of the leads of the resistor 19 is connected to the third connecting piece 30, which, in turn, is connected to the electrode 15. No bead 21 is therefore necessary for the situation shown in FIG. 3, in contrast with the situation shown in FIG. 2.

In the examples shown in the drawings, the resistor (9, 19) is arranged in series with the discharge tube (1 and 11*a* with 11*b*, respectively). It is alternatively conceivable that that resistor is arranged electrically in parallel with the discharge tube.

Figure 4:
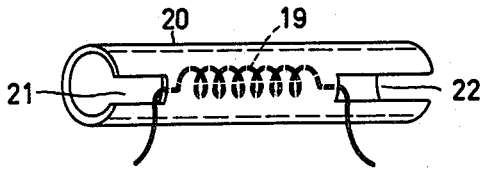
FIG. 4 is a perspective view of a hollow insulating element, shown in FIG. 2 and in FIG. 3, an electric resistor being arranged inside this element.

In FIG. 4 reference numeral 20 denotes the above-mentioned ceramic tube. This tube has a length of approximately 14 mm and an outside diameter of approximately 3.4 mm. The wall is approximately 0.6 mm thick. The tube 20 has been provided with cut-outs 21, 22, respectively, one at each end. Reference numeral 19 denotes the electrical resistor. The resistor 19 is fastened in the tube 20 via edges of the cut-outs 21 and 22.

The above-described embodiments of lamps according to the invention not only have a good vacuum in the space between the discharge tube and the outer bulb, but also have a relatively long life, which is more than 6000 hours for each of the described lamps.

What is claimed is:

1. A low-pressure metal vapor discharge lamp having a discharge tube arranged in an evacuated outer bulb, current conductors extending in a vacuum-tight manner through the wall of the outer bulb and the wall of the discharge tube into the discharge tube where they are each connected to a respective electrode, a barium-containing getter and an electric getter auxiliary means in the form of an electric resistor being present in the evacuated space between the discharge tube and the outer bulb, the resistor receiving in the operating condition of the lamp an electric current by way of the current conductors, the resistor having an operating temperature in the range from 500°–2000° C., characterized in that the resistor is enveloped for the greater part by a hollow insulating element.

2. A low-pressure metal vapour discharge lamp as claimed in claim 1, characterized in that the insulating element is a ceramic tube.

* * * * *